US010116100B2

(12) United States Patent
Feng et al.

(10) Patent No.: US 10,116,100 B2
(45) Date of Patent: Oct. 30, 2018

(54) ELECTRICAL CONNECTOR

(71) Applicant: LOTES CO., LTD, Keelung (TW)

(72) Inventors: Xiao Feng, Keelung (TW); Bo Zeng, Keelung (TW)

(73) Assignee: LOTES CO., LTD, Keelung (TW)

( * ) Notice: Subject to any disclaimer, the term of this patent is extended or adjusted under 35 U.S.C. 154(b) by 0 days.

(21) Appl. No.: 15/805,235

(22) Filed: Nov. 7, 2017

(65) Prior Publication Data

US 2018/0145462 A1 May 24, 2018

(30) Foreign Application Priority Data

Nov. 23, 2016 (CN) ..... 2016 2 1254414 U

(51) Int. Cl.

*H01R 13/6585* (2011.01)
*H01R 13/6596* (2011.01)
*H01R 13/6597* (2011.01)
*H01R 12/71* (2011.01)

(52) U.S. Cl.

CPC ..... *H01R 13/6597* (2013.01); *H01R 13/6585* (2013.01); *H01R 13/6596* (2013.01); *H01R 12/716* (2013.01)

(58) Field of Classification Search

CPC ..... H01R 12/716; H01R 13/6585; H01R 13/6591; H01R 13/6596; H01R 13/6597
USPC ..... 439/607.04, 607.08, 607.11, 607.34
See application file for complete search history.

(56) References Cited

U.S. PATENT DOCUMENTS

| | | | | |
|---|---|---|---|---|
| 8,968,031 | B2 * | 3/2015 | Simmel | H01R 13/659 439/660 |
| 9,590,364 | B1 * | 3/2017 | Chang | H01R 13/6581 |
| 2015/0087172 | A1 * | 3/2015 | Yu | H01R 13/6582 439/108 |
| 2016/0233629 | A1 | 8/2016 | Yen et al. | |
| 2016/0352050 | A1 * | 12/2016 | Hu | H01R 13/6597 |
| 2017/0070013 | A1 * | 3/2017 | Hsu | H01R 24/60 |
| 2017/0077651 | A1 * | 3/2017 | Chang | H01R 13/6594 |

(Continued)

FOREIGN PATENT DOCUMENTS

| | | | |
|---|---|---|---|
| CN | 201515051 | U | 6/2010 |
| CN | 104993287 | A | 10/2015 |

(Continued)

*Primary Examiner* — Edwin A. Leon
*Assistant Examiner* — Oscar Jimenez
(74) *Attorney, Agent, or Firm* — Locke Lord LLP; Tim Tingkang Xia, Esq.

(57) ABSTRACT

An electrical connector includes an insulating body, multiple terminals, a metal member, and a metal shell. The insulating body has a base and a tongue extending forward from the base. The terminals are fixed in the base and exposed to upper and lower surfaces of the tongue. The terminals include at least one ground terminal. The metal member is fixed on the insulating body. The metal member bends backward and extends to form an elastic arm. The elastic arm presses the ground terminal. The elastic arm has a protrusion portion, and the protrusion portion is higher than the top surface of the base. The metal shell wraps a periphery of the insulating body and the metal member. The protrusion portion urges the metal shell, to enable a stable electrical connection between the metal member and the ground terminal, so that the electrical connector has good high frequency transmission performance.

20 Claims, 6 Drawing Sheets

(56) References Cited

U.S. PATENT DOCUMENTS

| | | | | |
|---|---|---|---|---|
| 2017/0271820 | A1* | 9/2017 | Ho | H01R 13/6585 |
| 2018/0166830 | A1* | 6/2018 | Feng | H01R 12/71 |

FOREIGN PATENT DOCUMENTS

| | | | |
|---|---|---|---|
| CN | 105140686 | A | 12/2015 |
| CN | 204858155 | U | 12/2015 |
| CN | 204927638 | U | 12/2015 |
| CN | 105244654 | A | 1/2016 |
| CN | 105356167 | A | 2/2016 |
| CN | 105470735 | A | 4/2016 |
| CN | 205159673 | U | 4/2016 |
| CN | 205212085 | U | 5/2016 |
| CN | 205231372 | U | 5/2016 |
| CN | 205543504 | U | 8/2016 |
| CN | 205565176 | U | 9/2016 |
| TW | M501670 | | 5/2015 |
| TW | 201620212 | | 6/2016 |
| TW | 201620214 | | 6/2016 |

* cited by examiner

ELECTRICAL CONNECTOR

CROSS-REFERENCE TO RELATED APPLICATIONS

This non-provisional application claims priority to and benefit of, under 35 U.S.C. § 119(a), Patent Application No. 201621254414.8 filed in P.R. China on Nov. 23, 2016, the entire content of which is hereby incorporated by reference.

FIELD OF THE INVENTION

The present invention relates to an electrical connector, and more particularly to an electrical connector with good high frequency transmission performance.

BACKGROUND OF THE INVENTION

An existing universal serial bus (USB) Type-C electrical connector usually includes an insulating body, multiple terminals accommodated in the insulating body, a metal member, and a metal shell. The terminals include a differential signal terminal for transmitting a high frequency signal and a ground terminal, and are used to be soldered on a circuit board. The metal member is mounted and fixed on the insulating body and located at the outer side of the terminals. The metal shell wraps outside the insulating body, and is used to be soldered on the circuit board. The metal member and the ground terminal are conducted via an elastic arm for grounding, and the metal member is used for shielding noise signals at the surrounding of the terminals. However, since the contact between the elastic arm and the ground terminal is unstable and an assembling gap may inevitably exist during the assembly of the metal member and the metal shell, the elastic arm is unable to firmly urge the metal shell, so that the grounding effect of the metal member is not good and it is unable to have a good shielding impact on the terminals, and thereby the electrical connector cannot obtain good high frequency transmission performance.

Therefore, a heretofore unaddressed need exists in the art to address the aforementioned deficiencies and inadequacies.

SUMMARY OF THE INVENTION

In one aspect, the present invention relates to an electrical connector with good high frequency transmission performance.

In certain embodiments, an electrical connector includes an insulating body, multiple terminals, a metal member, and a metal shell. The insulating body has a base and a tongue extending forward from the base. The terminals are fixed in the base and exposed to upper and lower surfaces of the tongue. The terminals include at least one ground terminal. The metal member is fixed on the insulating body. The metal member bends and extends backward to form an elastic arm, and the elastic arm presses the ground terminal. The elastic arm is provided with a protrusion portion, and the protrusion portion is higher than the top surface of the base. The metal shell wraps a periphery of the insulating body and the metal member, and the protrusion portion urges the metal shell.

In certain embodiments, the metal shell includes a top wall, a bottom wall, and two side walls connecting the top wall and the bottom wall, and the protrusion portion urges the top wall.

In certain embodiments, the rear side of the base is provided with at least one escaping slot. The ground terminal is partially exposed to the escaping slot, and the elastic arm presses the ground terminal via the escaping slot.

In certain embodiments, the elastic arm extends upward from the metal member and then bends downward and extends to form a first bending portion. The protrusion portion is located at a bending position of the first bending portion.

In certain embodiments, the elastic arm bends downward from the first bending portion and extends to form a second bending portion, and the second bending portion is located in the escaping slot.

In certain embodiments, the second bending portion is formed by bending to a direction away from a rear end surface of the base.

In certain embodiments, the elastic arm bends forward from a free tail end of the second bending portion and extends to form an arc-shaped portion, and the arc-shaped portion presses the ground terminal.

In certain embodiments, a free tail end of the arc-shaped portion extends to a direction away from the ground terminal.

In certain embodiments, the metal member has a first section located on the tongue, a second section located on the base and a vertical section connecting the first section and the second section. The second section is higher than the first section, and the elastic arm extends backward from the second section.

In certain embodiments, the protrusion portion is higher than the second section.

In certain embodiments, the top surface of the base is recessed with a first groove, and the second section is clamped in the first groove.

In certain embodiments, a front end surface of the base is recessed with a second groove, the second groove is in communication with the first groove, and the vertical section is clamped to the second groove.

In certain embodiments, a chamfer is provided at a connecting position of the first groove and the second groove.

In certain embodiments, the terminals are arranged in an upper row and a lower row on the insulating body. Two of the terminals at the outermost side of the terminals in the upper row are both the ground terminals, and the elastic arm extends along two sides of the top surface of the base to press the two ground terminals at the outermost side.

In certain embodiments, the width of the elastic arm tapers in the extending direction.

Compared with the related art, certain embodiments of the present invention have the following beneficial advantages. The metal member is provided with an elastic arm to press the ground terminal, the elastic arm is provided with a protrusion portion, and the protrusion portion urges the metal shell. The protrusion portion is higher than the top surface of the base, and the metal shell interferes with and pushes the protrusion portion downward, so as to enable a stable electrical connection between the metal member and the ground terminal, and enhance the shielding effect of the electrical connector. In addition, the metal member is in contact with the ground terminal via the metal shell for grounding, which makes the metal member be grounding stably, so that good shielding protection can be performed on signal transmission of the multiple terminals and the resonance is reduced, which enables the electrical connector to have good high frequency transmission performance.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the invention and together with the written description, serve to explain the principles of the invention. Wherever possible, the same reference numbers are used throughout the drawings to refer to the same or like elements of an embodiment.

DETAILED DESCRIPTION OF THE INVENTION

Figure 1:
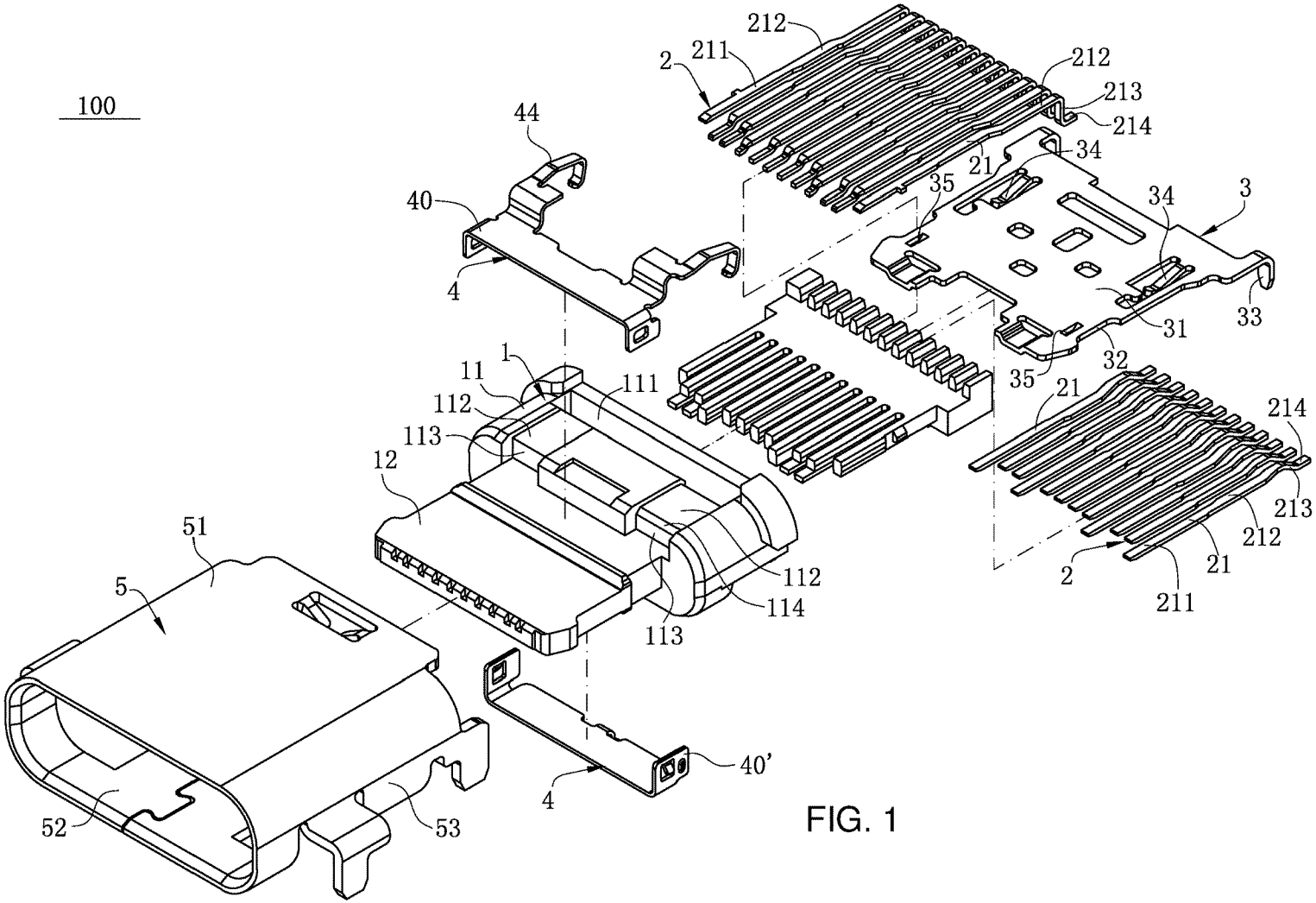
FIG. 1 is a schematic three-dimensional exploded view of an electrical connector according to one embodiment of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-6. In accordance with the purposes of this invention, as embodied and broadly described herein, this invention, in one aspect, relates to an electrical connector.

Figure 2:
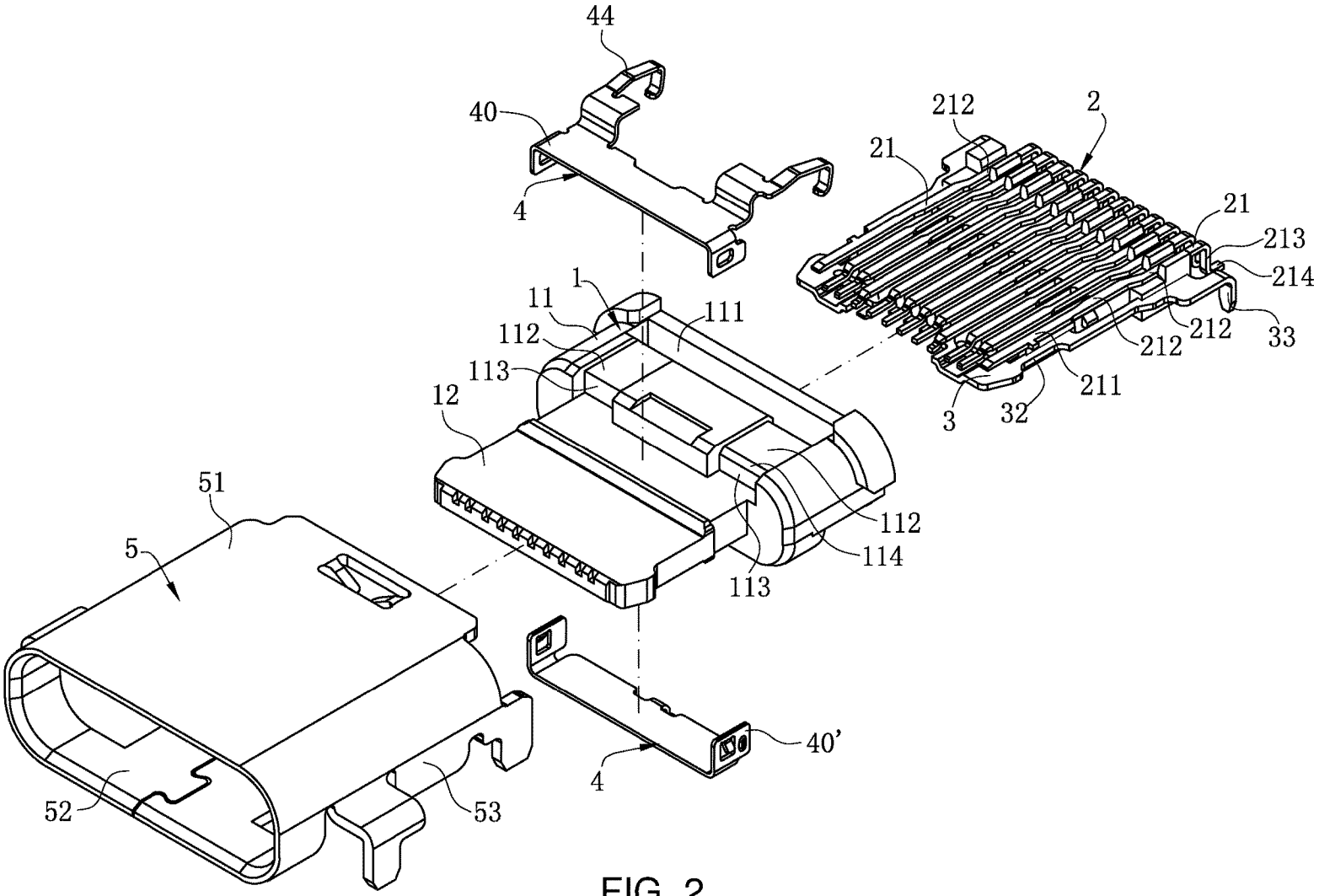
FIG. 2 is a schematic three-dimensional partial exploded view of an electrical connector according to one embodiment of the present invention.

As shown in FIGS. 1 and 2, as one preferable embodiment, the electrical connector 100 of the present invention is used for being mounted on a circuit board (not shown). The electrical connector 100 includes an insulating body 1, multiple terminals 2 received in the insulating body 1 and arranged in an upper row and a lower row on the insulating body 1, a shielding sheet 3 disposed in the insulating body 1 and located between the upper and lower rows of the terminals 2, a metal member 4 fixed on the insulating body 1, and a metal shell 5 wrapping the outer side of the insulating body 1.

The metal shell 5 encloses to form a mating cavity arranged 180 degrees symmetrically to wrap the insulating body 1. The metal shell 5 has multiple ground soldering pins correspondingly soldered on the circuit board. The metal shell 5 has a top wall 51, a bottom wall 52 and two side walls 53 connecting the top wall 51 and the bottom wall 52.

The insulating body 1 has a base 11 and a tongue 12 extending forward from the base 11. The base 11 is relatively wide and large, while the tongue 12 is relatively narrow and long. The top surface of the base 11 is recessed downward with an escaping slot 111. The escaping slot 111 is located at the rear side of the top surface of the base 11. The top surface of the base 11 is further recessed downward with a first groove 112. In this embodiment, there are two of the first grooves 112 respectively located at two sides of the top surface of the base 11. A front end surface of the base 11 is concavely provided backward with a second groove 113, and the second groove 113 is in communication with the first groove 112. A chamfer 114 is provided at a connecting position of the first groove 112 and the second groove 113 at one of the two sides of the top surface of the base 11.

The terminals 2 include at least one ground terminal 21. In this embodiment, there are four of the ground terminals 21 respectively located in the upper row and the lower row, and two of the terminals 2 at the outermost side of the terminals 2 in the upper row are both the ground terminals 21. In other embodiments, there may be one or more ground terminals 21, as long as it is ensured that the ground terminal(s) 21 can be in contact with the metal member 4. In this embodiment, each row has 12 terminals 2, and the 12 terminals 2 located in the upper row and the 12 terminals 2 located in the lower row are in a left-and-right opposite arrangement order and in an up-and-down symmetrical arrangement mode, and the transmitted signals are the same. The arrangement order from left to right of the multiple terminals 2 in the upper row is sequentially a ground terminal (GND) 21, a differential signal high-speed transmission terminal pair (TX1+, TX1−, i.e., a USB3.0 terminal 2) 2, a power terminal (Vbus) 2, a reserved terminal 2 (CC1), a USB2.0 differential terminal pair (Dp1, Dn1) 2, a reserved terminal (SBU1) 2, a power terminal (Vbus) 2, a differential signal high-speed receiving terminal pair (RX2+, RX2−) 2, and a ground terminal (GND) 21, i.e., the two terminals 2 at the outermost side of the multiple terminals 2 in the upper row are both the ground terminals 21; and the arrangement order from right to left of the multiple terminals 2 in the lower row is sequentially a ground terminal (GND) 21, a differential signal high-speed transmission terminal pair (TX2+, TX2−, i.e., a USB3.0 terminal 2) 2, a power terminal (Vbus) 2, a reserved terminal (CC2) 2, a USB2.0 differential terminal pair (Dp2, Dn2) 2, a reserved terminal (SBU2) 2, a power terminal (Vbus) 2, a differential signal high-speed receiving terminal pair (RX1+, RX1−) 2, and a ground terminal (GND) 21, i.e., the two terminals 2 at the outermost side of the multiple terminals 2 in the lower row are both the ground terminals 21. The multiple terminals 2 located in the upper and lower rows on the insulating body 1 are arranged in such a way that the electrical connector 100 can implement a function of being inserted in dual orientation.

Figure 3:
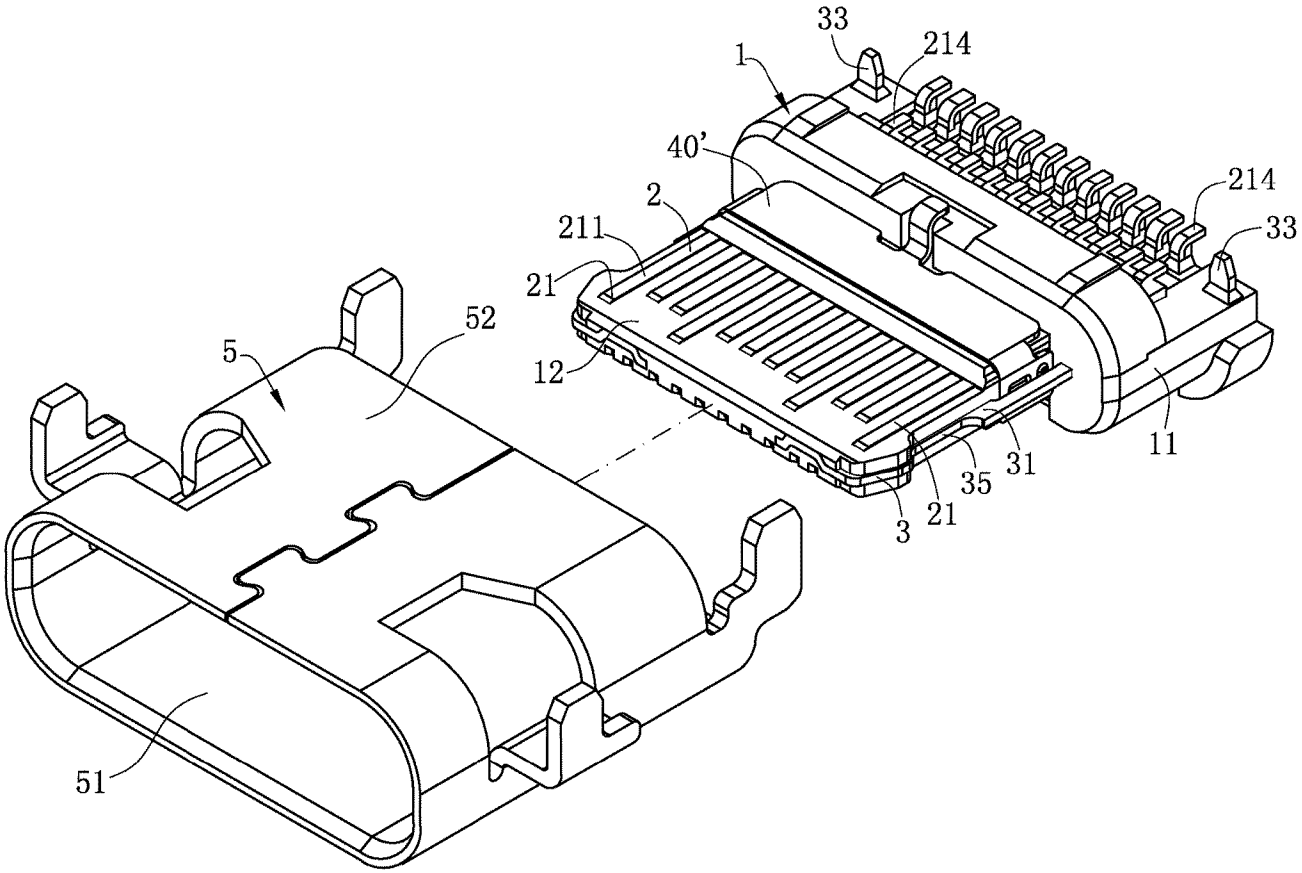
FIG. 3 is a schematic three-dimensional view of an electrical connector according to one embodiment of the present invention.

As shown in FIGS. 1 and 3, each of the terminal 2 is fixed in the base 11, and a front part of each terminal 2 has a contact portion 211 exposed to the upper or lower surfaces of the tongue 12 for guiding and connecting with a mating connector (not shown). Each terminal 2 extends horizontally backward, from the contact portion 211, a connecting portion 212. The connecting portion 212 is fixed at the rear end of the tongue 12 and extends to the base 11. Each terminal 2 further has a soldering arm 213 bends vertically and extends backward from the connecting portion 212, and a soldering portion 214 extending from the tail end of the soldering arm 213 and extending out of the escaping slot 111, for being soldered on the circuit board. The soldering portion 214 of the ground terminal 21 is soldered on a ground path of the circuit board.

The shielding sheet 3 is formed by punching a sheet metal, and includes a plate portion 31 provided on the tongue 12 and located between the contact portions 211 and the connecting portions 212 of the upper rows of the terminals 2 and the lower rows of the terminals 2. Each of the two side edges of the plate portion 31 is respectively concavely provided with a clamping slot 32 to clamp the mating connector. Each of the two sides of the rear end of the plate portion 31 is respectively provided with a fixing pin 33. The fixing pins 33 respectively extend backward from the rear end of the plate portion 31 and then bend downward and extend out of the bottom surface of the base 11, and the two fixing pins 33 are soldered on the circuit board. An elastic piece 34 is downward provided at the rear side of the shielding sheet 3, and the elastic piece 34 presses the corresponding ground terminal 21. A protrusion block 35 is downward provided at the front side of the shielding sheet 3 in a protruding manner, and the protrusion block 35 presses the corresponding ground terminal 21. The protrusion block 35 and the elastic piece 34 presses the same ground terminal 21. In this embodiment, the left and right sides of the shielding sheet 3 are respectively provided with one protrusion block 35 and one elastic piece 34. Therefore, interference signals between the upper and lower rows of terminals 2 are shielded, so as to enhance the shielding effect of the electrical connector 100.

Figure 4:
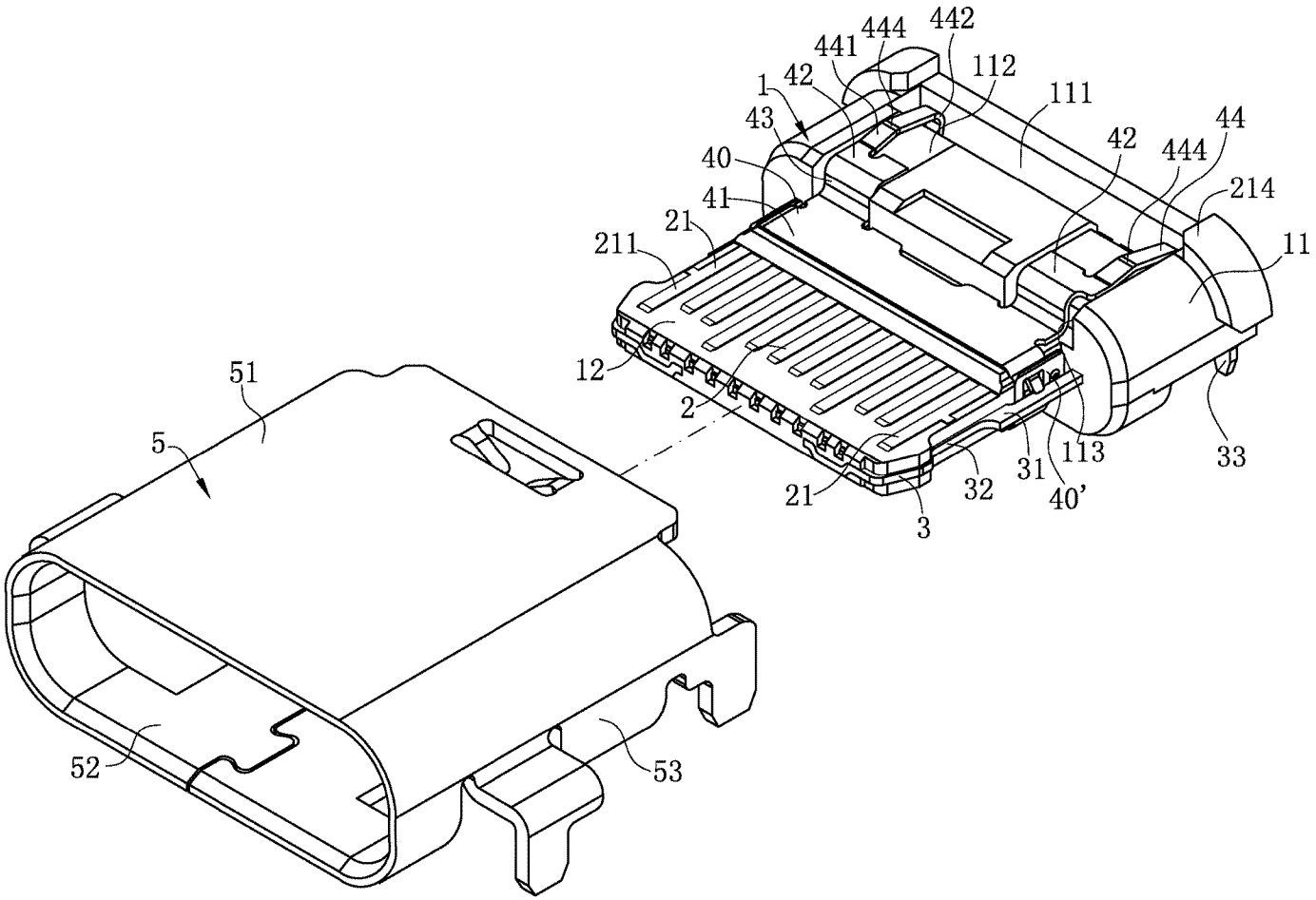
FIG. 4 is an exploded view of an electrical connector from another angle according to one embodiment of the present invention.
Figure 5:
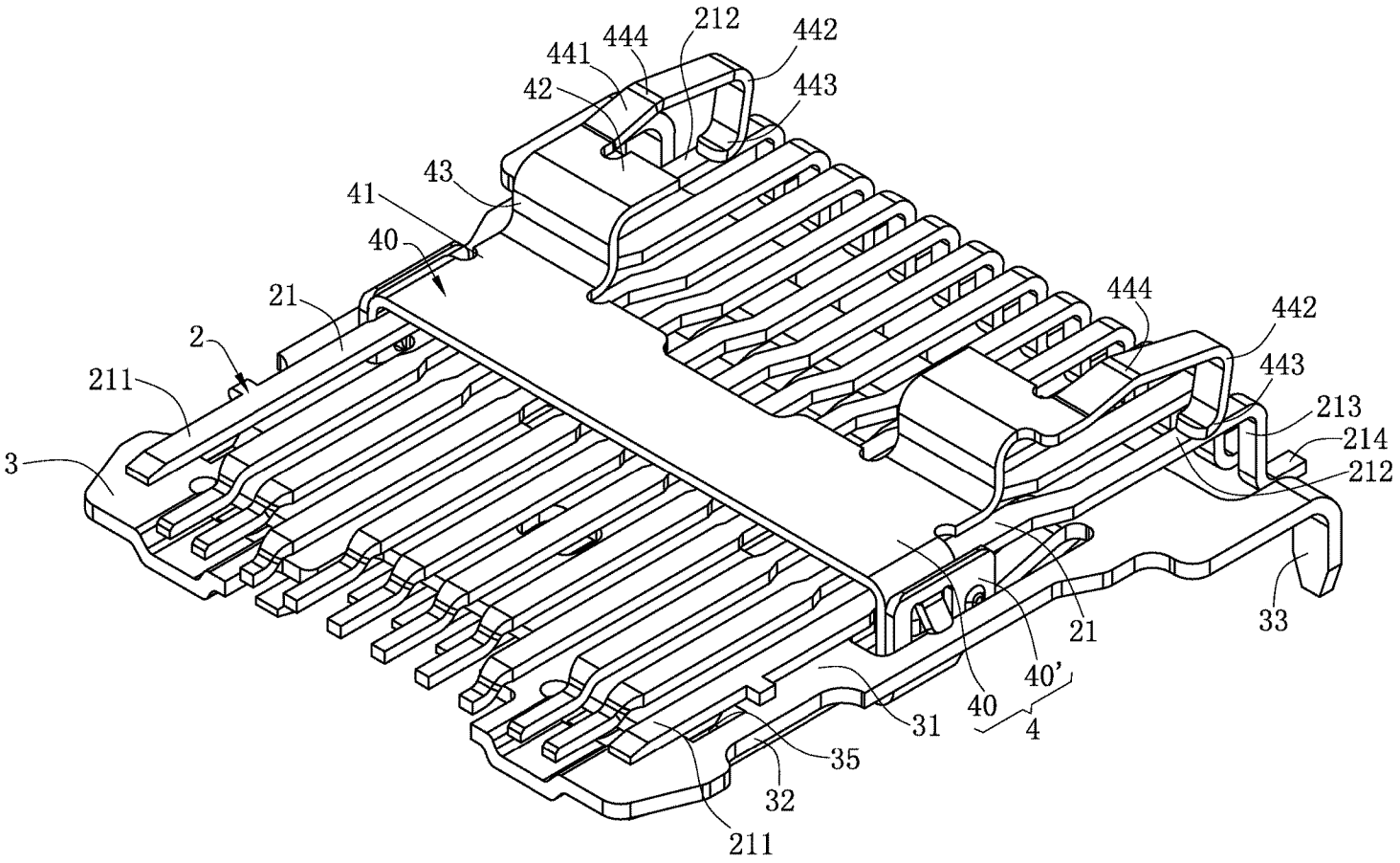
FIG. 5 is a component view of an electrical connector according to one embodiment of the present invention.
Figure 6:
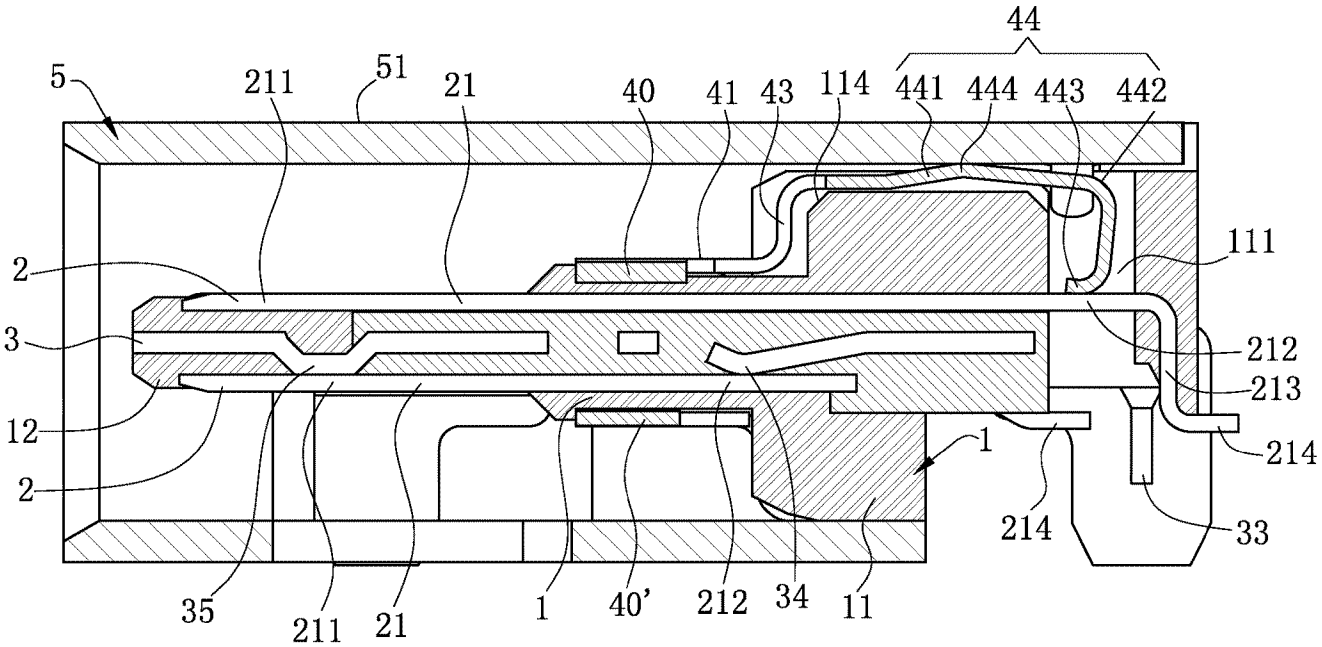
FIG. 6 is a sectional view of an electrical connector according to one embodiment of the present invention.

As shown in FIGS. 4-6, the metal member 4 is fixed at the position, near the base 11, on the tongue 12 and partially extends to the base 11, and the metal member 4 is of a metal material.

In this embodiment, the metal member 4 includes a first metal member 40 and a second metal member 40'. The first metal member 40 is located at an upper side of the insulating body 1, the second metal member 40' is located at a lower side of the insulating body 1, and the terminals 2 in the upper and lower rows are located between the first metal member 40 and the second metal member 40', i.e., the first metal member 40 is located at an upper side of the upper row of terminals 2, while the second metal member 40' is located at a lower side of the lower row of terminals 2. The first metal member 40 has a first section 41 located on the tongue 12, a second section 42 located on the base 11 and a vertical section 43 connecting the first section 41 and the second section 42. The second section 42 is higher than the first section 41. The second section 42 is clamped to the first groove 112, and the vertical section 43 is clamped to the second groove 113. A connecting position of the second section 42 and the vertical section 43 is located on the chamfer 114 at a connecting position of the first groove 112 and the second groove 113 at the one side of the top surface of the base 11. The metal member 4 bends backward and extends to form an elastic arm 44, and the elastic arm 44 presses the corresponding ground terminal 21. In certain embodiments, the elastic arm 44 extends along two sides of the top surface of the base 11 to press the two ground terminals 21 at the outermost side. The elastic arm 44 is provided with a protrusion portion 444, and the protrusion portion 444 is higher than the top surface of the base 11. The protrusion portion 444 urges the metal shell 5. In this embodiment, preferably, the elastic arm 44 extends upward from the second section 42 and then bends downward and extends to form a first bending portion 441, and the protrusion portion 444 is located at a bending position of the first bending portion 441. The protrusion portion 444 is higher than the second section 42. The protrusion portion 444 urges the top wall 51 of the metal shell 5. The elastic arm 44 bends downward from the first bending portion 441 and extends to form a second bending portion 442, and the second bending portion 442 is located in the escaping slot 111. The second bending portion 442 is formed by bending and extending to a direction away from a rear end surface of the base 11. The elastic arm 44 bends forward from a free tail end of the second bending portion 442 and extends to form an arc-shaped portion 443. The arc-shaped portion 443 presses the ground terminal 21. A free tail end of the arc-shaped portion 443 extends to a direction away from the ground terminal 21. The width of the elastic arm 44 tapers in the extending direction, so that the part, at the top surface of the base 11, of the elastic arm 44 is relatively thick and has better stability, while the part close to the ground terminal 21 is relatively thin and is close to the width of the ground terminal 21, which can provide better surface contact with the ground terminal 21.

The protrusion portion 444 is higher than the top surface of the base 11 and urges the top wall 51 of the metal shell 5, and a top wall of the metal shell 5 interferes with and pushes the protrusion portion 444 downwards, so that the elastic arm 44 may have better contact with the ground terminal 21. In addition, the second bending portion 442 is located in the escaping slot 111 to avoid backward movement of the elastic arm 44, so that the arc-shaped portion 443 is in good contact with the ground terminal 21.

In summary, the electrical connector 100 component according to certain embodiments of the present invention, among other things, has the following beneficial advantages.

(1) The metal member 4 is provided with an elastic arm 44 to press the ground terminal 21, the elastic arm 44 is provided with a protrusion portion 444, and the protrusion portion 444 is higher than the top surface of the base 11 and urges the metal shell 5. The metal shell 5 may interfere with and push the protrusion portion 444 downward, so that the elastic arm 44 presses the ground terminal 21 and the metal shell 5 more stably, such that the metal member 4 can be grounded stably, thereby being able to have good shielding protection for signal transmission of the terminals 2, reducing resonance, and enabling the electrical connector 100 to have good high frequency transmission performance.

(2) The ground terminals 21 are exposed to the escaping slot 111, and the elastic arm 44 presses the corresponding ground terminal 21 via the escaping slot 111, which may reduce costs.

(3) The second bending portion 442 of the elastic arm 44 is located in the escaping slot 111 and extends to a direction away from a rear end surface of the base 11 to avoid backward movement of the elastic arm 44 when the metal shell 5 interferes with and pushes the elastic arm 44 downward, so that the elastic arm 44 presses the corresponding ground terminal 21 more stably.

(4) The arc-shaped portion 443 presses the corresponding ground terminal 21, and a free tail end of the arc-shaped portion 443 extends to a direction away from the ground terminal 21, so that when the metal shell 5 interferes with and pushes the elastic arm 44 downward, the arc-shaped portion 443 is in better contact with the ground terminal 21 in a sliding process.

(5) The width of the elastic arm 44 tapers in the extending direction, so that the part, at the top surface of the base 11, of the elastic arm 44 is relatively thick and has better stability, while the part close to the ground terminal 21 is relatively thin and is close to the width of the ground terminal 21, which can provide better surface contact with the ground terminal 21.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments are chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connector, comprising: an insulating body, having a base and a tongue extending forward from the base; a plurality of terminals, fixed in the base and exposed to upper and lower surfaces of the tongue, and comprising at least one ground terminal; a metal member fixed on the insulating body, wherein the metal member bends backward and extends to form an elastic arm, the elastic arm presses the at least one ground terminal, the elastic arm is provided with a protrusion portion, and the protrusion portion is higher than a top surface of the base; and a metal shell, wrapping a periphery of the insulating body and the metal member, the protrusion portion urging the metal shell, wherein the metal member has a first section located on the tongue, a second section located on the base, and a vertical section connecting the first section and the second section, the second section is higher than the first section, and the elastic arm extends backward from the second section.

2. The electrical connector of claim 1, wherein the metal shell comprises a top wall, a bottom wall, and two side walls connecting the top wall and the bottom wall, and the protrusion portion urges the top wall.

3. The electrical connector of claim 1, wherein a rear side of the base is provided with at least one escaping slot, the at least one ground terminal is partially exposed to the escaping slot, and the elastic arm presses the ground terminal via the escaping slot.

4. The electrical connector of claim 1, wherein the protrusion portion is higher than the second section.

5. The electrical connector of claim 4, wherein the top surface of the base is recessed with a first groove, and the second section is clamped in the first groove.

6. The electrical connector of claim 5, wherein a front end surface of the base is recessed with the second groove, the second groove is in communication with the first groove, and the vertical section is clamped in the second groove.

7. The electrical connector of claim 1, wherein a width of the elastic arm tapers in an extending direction.

8. An electrical connector, comprising: an insulating body, having a base and a tongue extending forward from the base; a plurality of terminals, fixed in the base and exposed to upper and lower surfaces of the tongue, and comprising at least one ground terminal; a metal member fixed on the insulating body, wherein the metal member bends backward and extends to form an elastic arm, the elastic arm presses the at least one ground terminal, the elastic arm is provided with a protrusion portion, and the protrusion portion is higher than a top surface of the base; and a metal shell, wrapping a periphery of the insulating body and the metal member, the protrusion portion urging the metal shell, wherein the elastic arm extends upward from the metal member and then bends downward and extends to form a first bending portion, and the protrusion portion is located at a bending position of the first bending portion.

9. The electrical connector of claim 8, wherein the elastic arm bends downward from the first bending portion and extends to form a second bending portion, and the second bending portion is located in the escaping slot.

10. The electrical connector of claim 9, wherein the second bending portion is formed by bending toward a direction away from a rear end surface of the base.

11. The electrical connector of claim 9, wherein the elastic arm bends forward from a tail end of the second bending portion and extends to form an arc-shaped portion, and the arc-shaped portion pressed the at least one ground terminal.

12. The electrical connector of claim 11, wherein a tail end of the arc-shaped portion extends to a direction away from the at least one ground terminal.

13. An electrical connector, comprising: an insulating body, having a base and a tongue extending forward from the base; a plurality of terminals, fixed in the base and exposed to upper and lower surfaces of the tongue, and comprising at least one ground terminal, wherein the terminals are arranged in an upper row and a lower row on the insulating body, two of the terminals at outermost side of the terminals in the upper row are both the ground terminals; a metal member fixed on the insulating body, wherein the metal member bends backward and extends to form two elastic arms, the two elastic arms respectively extend along two sides of the top surface of the base to press the two ground terminals at the outermost side, each of the elastic arms is provided with a protrusion portion, and the protrusion portion is higher than a top surface of the base; and a metal shell, wrapping a periphery of the insulating body and the metal member, the protrusion portions urging the metal shell.

14. The electrical connector of claim 13, wherein the metal shell comprises a top wall, bottom wall, and two side walls connecting the top wall and the bottom wall, and the protrusion portion urges the top wall.

15. The electrical connector of claim 13, wherein a rear side of the base is provided with at least one escaping slot, the at least one ground terminal is partially exposed to the escaping slot, and the elastic arm presses the around terminal via the escaping slot.

16. The electrical connector of claim 15, wherein the elastic arm extends upward from the metal member and then bends downward and extends to form a first bending portion, and the protrusion portion is located at a bending position of the first bending portion.

17. The electrical connector of claim 13, wherein the metal member has a first section located on the tongue, a second section located on the base, and a vertical section connecting the first section and the second section, the second section is higher than the first section, and the elastic arm extends backward from the second section.

18. The electrical connector of claim 17, wherein the protrusion portion is higher than the second section.

19. The electrical connector of claim 18, wherein the top surface of the base is recessed with a first groove, and the second section is clamped in the first groove.

20. The electrical connector of the claim 13, wherein a width of the elastic arm tapers in an extending direction.

* * * * *